US008953734B2

(12) United States Patent
Trigger

(10) Patent No.: US 8,953,734 B2
(45) Date of Patent: Feb. 10, 2015

(54) TRANSITION UNIT

(75) Inventors: Vernon A. Trigger, Bloomfield Hills, MI (US); Jerry B. Morof, legal representative, Bloomfield Hills, MI (US); Claire T. Brown, legal representative, Anderson, SC (US); Marjorie T. Wyman, legal representative, Ft. Myers, FL (US)

(73) Assignee: Endless Energy, LLC, Bloomfield Hills, MI (US)

( * ) Notice: Subject to any disclaimer, the term of this patent is extended or adjusted under 35 U.S.C. 154(b) by 2123 days.

(21) Appl. No.: 11/861,979

(22) Filed: Sep. 26, 2007

(65) Prior Publication Data

US 2008/0183026 A1 Jul. 31, 2008

Related U.S. Application Data

(63) Continuation-in-part of application No. 10/217,990, filed on Aug. 13, 2002, now abandoned.

(51) Int. Cl.
*G21C 19/00* (2006.01)
*C10L 9/00* (2006.01)

(52) U.S. Cl.
CPC ..... *C10L 9/00* (2013.01)
USPC ..... 376/272; 376/273

(58) Field of Classification Search
CPC ..... C10J 3/56
USPC ..... 376/272–275
See application file for complete search history.

(56) References Cited

U.S. PATENT DOCUMENTS

| | | | | |
|---|---|---|---|---|
| 4,411,871 | A | 10/1983 | Gulbrandsen et al. | |
| 5,575,591 | A * | 11/1996 | Vanderklaauw | 405/230 |
| 5,908,558 | A | 6/1999 | Holland | |
| 5,920,602 | A * | 7/1999 | Botzem et al. | 376/272 |
| 6,156,969 | A * | 12/2000 | Schutz | 174/17 LF |

FOREIGN PATENT DOCUMENTS

JP 2002-136859 A 5/2002

OTHER PUBLICATIONS

Office Action from Canadian Intellectual Property Office for Application No. 2,536,363 dated Apr. 9, 2013.

* cited by examiner

*Primary Examiner* — Natalia Levkovich
(74) *Attorney, Agent, or Firm* — Rader, Fishman & Grauer PLLC

(57) ABSTRACT

The transition unit includes an outer cylinder that is cylindrically shaped and made of steel. A foundation for supporting the outer cylinder is provided. The foundation contains no metal reinforcements. Grounding rods are connected to the outer cylinder. The grounding rods extend to a water table. A lower support structure made preferably of wood is located within the outer cylinder. An inner cylinder is supported by the lower support structure. A canister is located within the inner cylinder. A cover is located on the outer cylinder for enclosing the transition unit.

18 Claims, 4 Drawing Sheets

TRANSITION UNIT

CROSS REFERENCE TO RELATED APPLICATIONS

This continuation-in-part application claims priority to U.S. patent application Ser. No. 10/217,990 filed Aug. 13, 2002, now abandoned the disclosure of which is incorporated by reference in its entirety.

FIELD OF THE INVENTION

The transition unit of the present invention relates to an underground storage apparatus.

BACKGROUND AND SUMMARY OF THE INVENTION

The transition unit includes an outer cylinder that is cylindrically shaped and made of steel. A foundation for supporting the outer cylinder is provided. The foundation contains no metal reinforcements. Grounding rods are connected to the outer cylinder. The grounding rods extend to a water table. A lower support structure made preferably of wood is located within the outer cylinder. An inner cylinder is supported by the lower support structure. A canister is located within the inner cylinder. A cover is located on the outer cylinder for enclosing the transition unit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
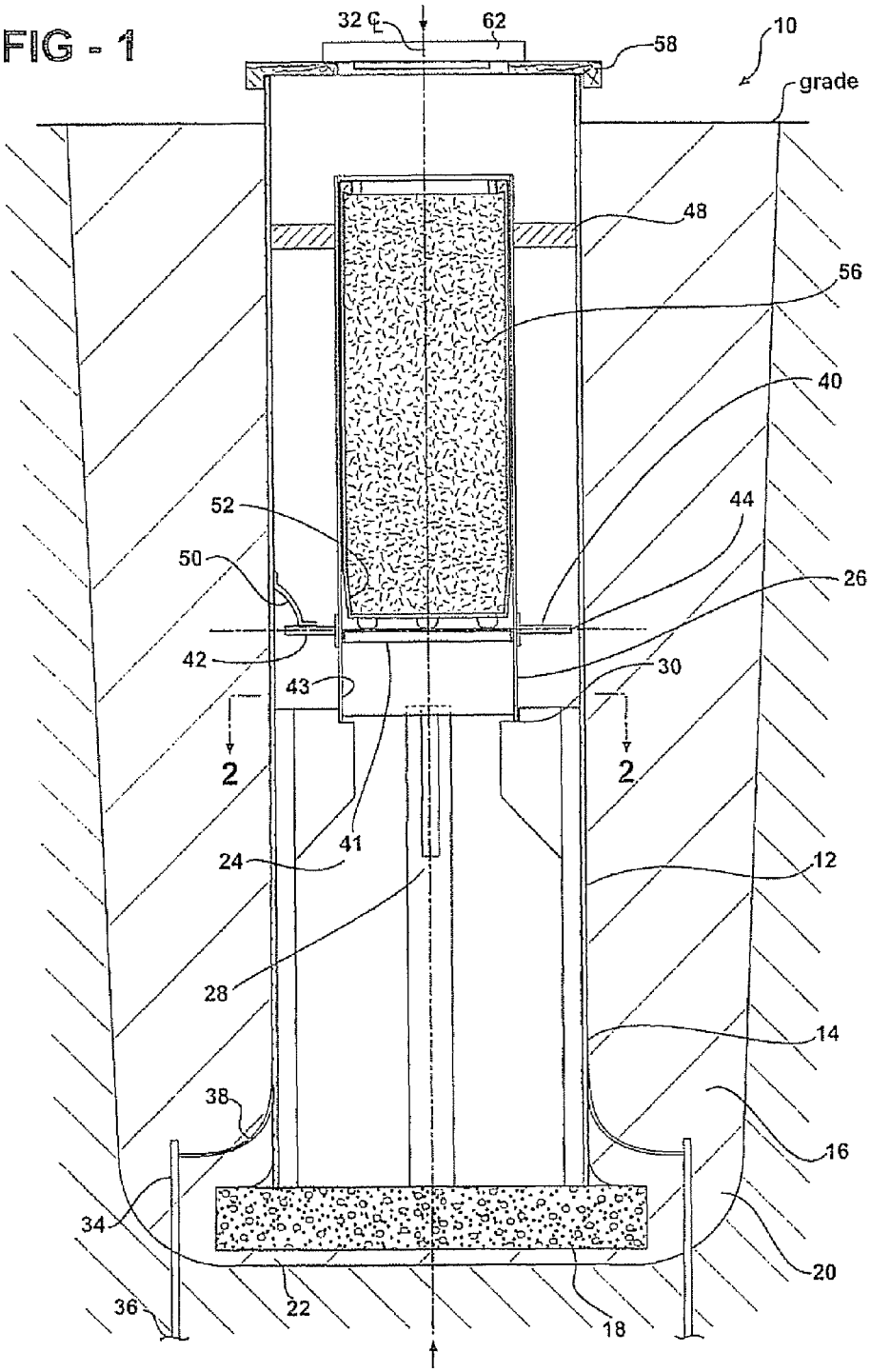
FIG. 1 is a side elevational view of a transition unit that has been located within the ground, where substances have been located within a canister.
Figure 2:
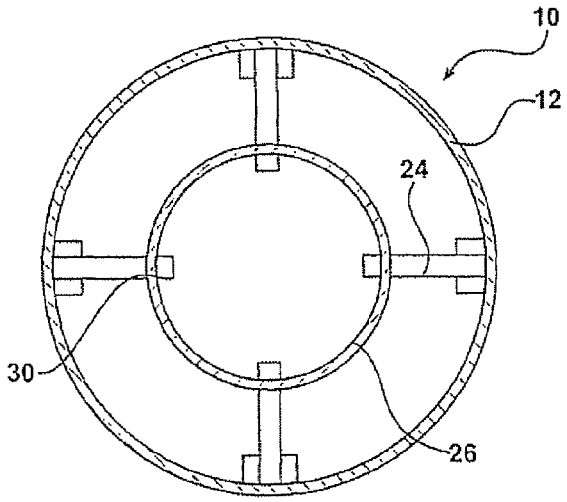
FIG. 2 is a top elevational view taken from the direction of Arrow 2-2 as shown in FIG. 1, illustrating the outer cylinder relative to the inner cylinder.

The following description of the preferred embodiment(s) is merely exemplary in nature and is in no way intended to limit the invention, its application, or uses.

The present invention is a transition unit 10. The transition unit 10 is an assembly that is preferably located sub grade.

The transition unit 10 includes an elongated outer cylinder 12 that is preferably made of magnetic stainless steel. The cylinder 12 is located within a hole 14 in the ground 16 at a position vertical to the ground 16. A concrete slab 18, free of metal, is placed over a vapor barrier on well compacted sand and gravel fill 20. The slab 18 must be perfectly level and a drain sump 22 is positioned below the elevation of the slab 18 for removing water.

A base 24, supported by the slab 18, is located at the lower end of the outer cylinder 12 for supporting an inner cylinder 26. The base 24 includes four separate wings 28 that are offset at 90 degree angles from one another. Each wing 28 is preferably made of wood and the base 24 is centrally positioned within the outer cylinder 12 in order to maintain trueness. A recess 30 at the upper end of each wing provides a centering feature for locating the lower part of inner cylinder 26 precisely in place relative to the centerline 32. The centerline 32 extends axially in the outer cylinder 12 and is vertical to the ground.

A plurality of grounding rods 34 is driven to the water table 36 in order to establish a ground. Each grounding rod 34 is connected to the outer cylinder 12 by a copper braid 38 in order to ground the outer cylinder 12.

The inner cylinder 26 is preferably made of non-magnetic stainless steel and has an outside diameter of K and a length of Kx Pi. K is a variable and starting point for the configuration and manufacture of the unit 10. K represents the diameter of the inner cylinder. K is a variable and starting point for the configuration and manufacture of the unit 10. K represents the diameter of the inner cylinder. K could be in the range of 10-140 inches in diameter. A flange 40, has a width of K/Pi, and is positioned at the lower end of the inner cylinder 26 at a distance of K/2 from the lower end of the cylinder. The outside diameter of the flange 40 is K+2(K/Pi). The space between the inside diameter of the outer cylinder 12 and the edge of the flange 40 is K/4Pi. The positioning is precise and the flange 40 is preferably made of magnetic silicon steel. A plate 41 located within the cylinder 26 is aligned with a centerline 42 that extends through the flange 40 which is also at a right angle from the wall 43 of the inner cylinder 26. The outer cylinder 12 has a midpoint 44 and the inner cylinder 26 is positioned so that the centerline 42 is in alignment. The length of the outer cylinder 12 is (Kx 2Pi)+2(K/4Pi) and its inside diameter is K+2(K/Pi)+2(K/4Pi).

Struts 48 are positioned between the inner wall of the outer cylinder 12 and the outer wall of the inner cylinder 26 for arranging the inner cylinder 26 in a perfectly upright position. The struts 48 are preferably made of wood and are spaced equally around the perimeter of the inner cylinder 26. Copper wire braids are a cable connection 50. The cable connection 50 grounds the flange 40 to the outer cylinder 12.

A canister 52 for housing substances is located within the inner cylinder 26. The canister 52 is preferably made of aluminum alloy and has a diameter that is slightly smaller than the inside diameter of the inner cylinder 26 so as to provide a loose fit there between. The canister 52 has an open top that is recessed below the top of the inner cylinder 26. Pads or bumpers made preferably of neoprene are secured to the bottom of the canister 52 for aiding in the insertion of the canister 52 into the inner cylinder 26 and on top of the plate 41.

Figure 3:
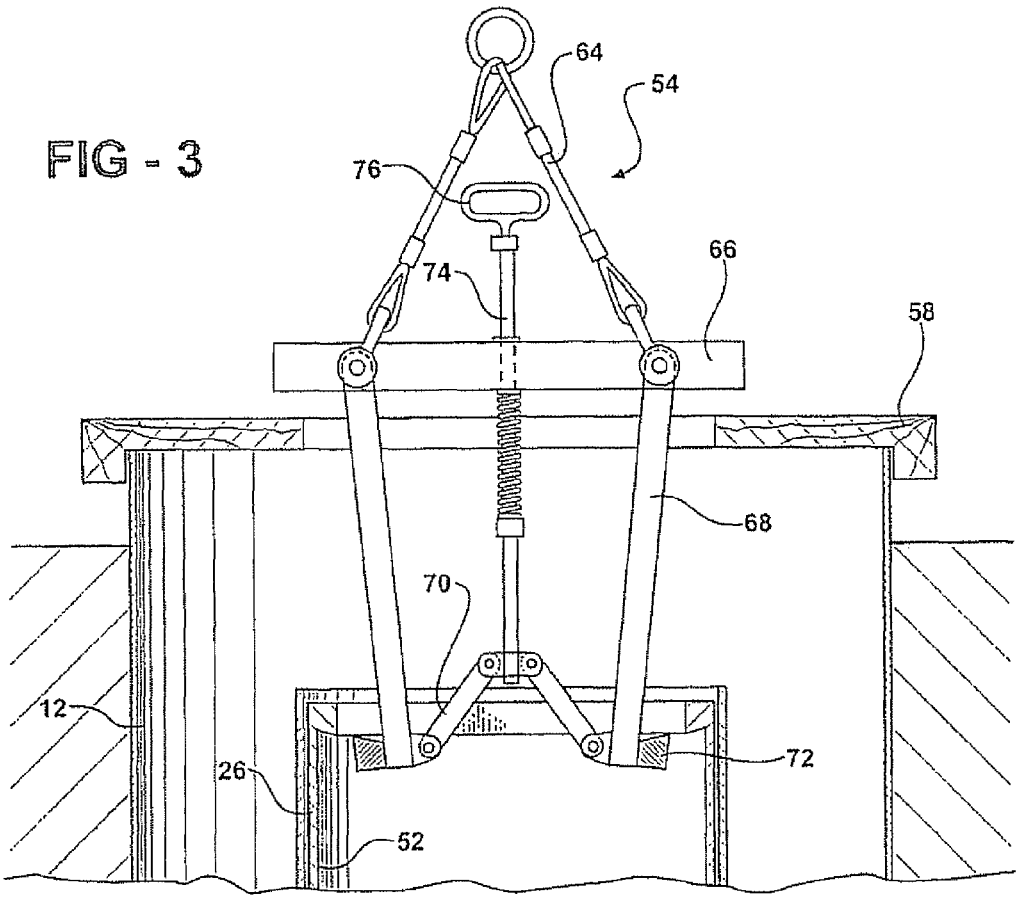
FIG. 3 is a side elevational view of the hoisting cable in the retracted position that is utilized to maneuver the canister to and from the transition unit.
Figure 4:
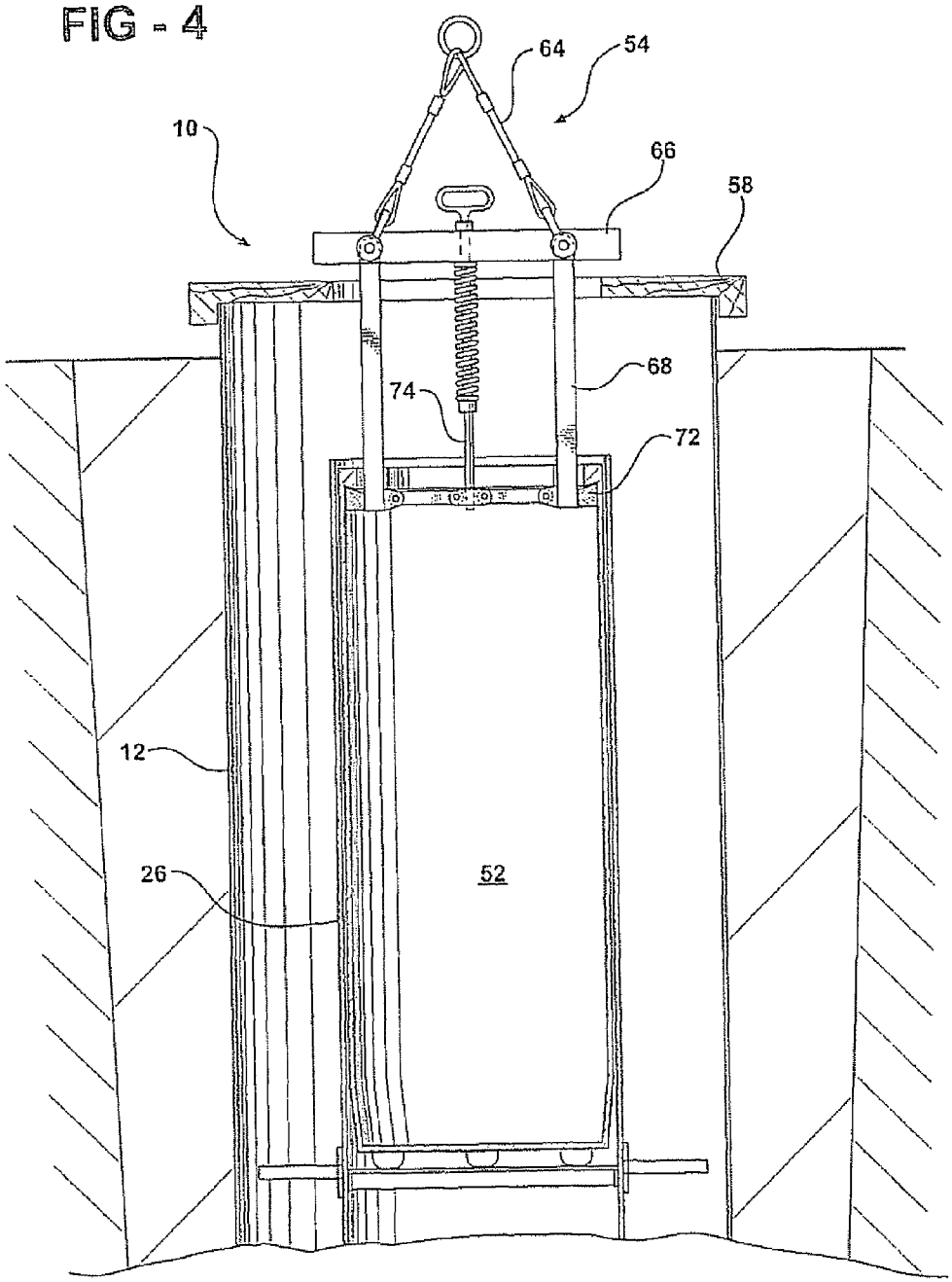
FIG. 4 is a side elevational view of the hoisting cable mechanism in an engaged position showing the canister properly inserted within the inner cylinder.

With reference to FIGS. 3 and 4, the canister 52 can be easily removed to and from the transition unit 10 by a hoist assembly 54. The hoist assembly 54 allows the canister 52 to be removed and substances 56 to be put into the transition unit 10 for processing. A top panel 58 that is preferably made of wood extends over the opening of the outer cylinder 12. An access hole 60 in the top panel 58 can be accessed by removing cover 62. Once the cover 62 is removed, the hoist assembly 54 can be lowered within the outer cylinder 12 to facilitate maneuvering of the canister 52.

The hoist assembly 54 includes cables 64 that in turn are connected to a plate 66. Suspension bars 68 are pivotally connected to the plate 66 at one end, and at the other end to linkage rods 70. Lifting bars 72 extend outwardly from the suspension bars 68 for engaging an inner surface of the canister 52. The inner and outer movement of the lifting bars 72 is effectuated by a control rod 74 that extends vertically through the plate 66. A handle 76 connected to the control rod 74 allows an operator to lift the rod 74 into a disengaged position as shown in FIG. 3, or to an engaged position as shown in FIG. 4. When the hoist assembly 54 is in the engaged position, the canister 52 can be maneuvered to or from the transition unit 10. The transition unit 10 can be reused repeatedly by removing the canister 52 from the inner cylinder 26. Thus, the canister 52 is not permanently placed into the ground 16. This flexibility allows the transition unit 10 to be used over and over again such that a variety of substances 56 can be placed in the canister 52. The processed substances 56 can be solid or liquid. The canister 52 is operable of being repeatedly removed from the inner cylinder 26, filled with a substance 56, and relocated within the inner cylinder 26.

Figure 5:
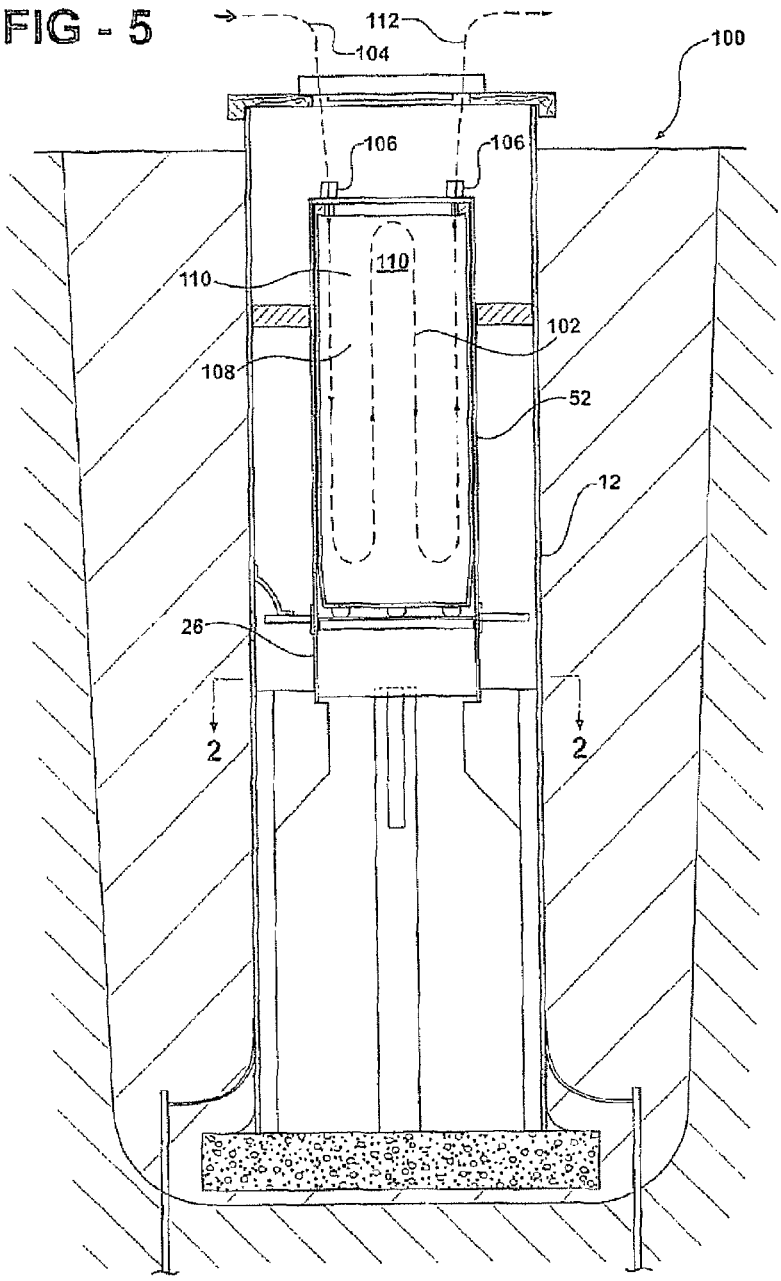
FIG. 5 is an alternative embodiment of the present invention, illustrating a transition unit.

FIG. 5 depicts an alternative transition unit 100. The transition unit 100 is designed substantially the same as the transition unit 10 as previously discussed, except that the transition unit 100 is operable to specifically handle fluids. The transition unit 100 includes an outer cylinder 12, a slab 18, grounding rods 34, a base 24, and inner cylinder 26 and a canister 52. However, the new aspects are the fluid means 102 that transports fluid to and from the transition unit 100. An inlet 104 provides a supply of fluid, or even a gas, into the transition unit 100 by means of piping. Connectors 106 allow for quick disconnect of the fluid lines from the canister 52. Within the canister 52 are circulation lines 108 that pass the incoming contaminated fluids through a field 110. An outlet 112 transports fluid from the transition unit 100 to where it can now be used. It will be appreciated that the transition units 10 and 100 can be modified to handle other substances by modifying their size and configuration.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A transition unit comprising:

an inner cylinder within an outer cylinder, said outer cylinder being made of a magnetic material and said inner cylinder being made of a non-magnetic material; and a canister configured to retain a substance, said canister being insertable into said inner cylinder and removable from within said inner cylinder.

2. The transition unit as claimed in claim 1, wherein said outer cylinder is made of a magnetic steel, said inner cylinder is made of a non-magnetic steel, and said canister is made of aluminum alloy.

3. The transition unit as claimed in claim 1, further comprising:

struts positioned between said outer cylinder and said inner cylinder, said struts maintaining said inner cylinder in an upright position.

4. The transition unit as claimed in claim 1, wherein said outer cylinder is made of a magnetic steel.

5. The transition unit as claimed in claim 1, wherein said inner cylinder is made of a non-magnetic steel.

6. The transition unit as claimed in claim 1, wherein said outer cylinder and said inner cylinder are arranged along a common center line, said common center line being vertical to the earth.

7. The transition unit as claimed in claim 1, further comprising:

a grounding rod connected to said outer cylinder, said grounding rod being extendable to a water table.

8. The transition unit as claimed in claim 1, further comprising:

a cable connection physically connected to said outer cylinder and said inner cylinder.

9. The transition unit as claimed in claim 1, further comprising:

a flange located around a perimeter of the inner cylinder.

10. The transition unit as claimed in claim 9, wherein said flange is made of magnetic silicon steel.

11. The transition unit as claimed in claim 1, further comprising:

a cover configured to enclose said inner cylinder and said canister within said outer cylinder, said cover being removable from said outer cylinder.

12. The transition unit as claimed in claim 11, wherein a top panel extends over an opening of the outer cylinder, said cover extending over an opening through the top panel.

13. The transition unit as claimed in claim 11, wherein said cover and an upper portion of the outer cylinder are positionable above grade, a lower portion of the outer cylinder being positionable below the grade.

14. The transition unit as claimed in claim 11, wherein an inlet extends through said cover, said inlet being configured to a supply a fluid or gas into said canister.

15. The transition unit as claimed in claim 12, wherein an outlet extends through said cover into said canister.

16. The transition unit as claimed in claim 1, further comprising:

a hoist configured to engage said inner cylinder.

17. The transition unit as claimed in claim 1, further comprising:

a lower support structure configured to support said inner cylinder, said lower support structure being within said outer cylinder; and a slab configured to support said lower support structure and said outer cylinder.

18. The transition unit as claimed in claim 17, wherein said slab is between said outer cylinder and a drain sump, said drain sump being configured to remove water.

* * * * *